US010342367B2

(12) United States Patent
Dimotsantos

(10) Patent No.: US 10,342,367 B2
(45) Date of Patent: Jul. 9, 2019

(54) BABY SLEEP COMFORT SYSTEM

(71) Applicant: Evangelos Dimotsantos, Las Vegas, NV (US)

(72) Inventor: Evangelos Dimotsantos, Las Vegas, NV (US)

( * ) Notice: Subject to any disclaimer, the term of this patent is extended or adjusted under 35 U.S.C. 154(b) by 85 days.

(21) Appl. No.: 15/225,718

(22) Filed: Aug. 1, 2016

(65) Prior Publication Data

US 2017/0027243 A1 Feb. 2, 2017

Related U.S. Application Data

(60) Provisional application No. 62/199,731, filed on Jul. 31, 2015.

(51) Int. Cl.

| | |
|---|---|
| ***A47G 9/10*** | (2006.01) |
| ***A41D 1/215*** | (2018.01) |
| ***A47D 5/00*** | (2006.01) |
| ***A47C 7/00*** | (2006.01) |
| *A41D 13/04* | (2006.01) |

(52) U.S. Cl.

CPC ..... *A47G 9/10* (2013.01); *A41D 1/215* (2018.01); *A47C 7/00* (2013.01); *A47D 5/006* (2013.01); *A41D 13/04* (2013.01); *A41D 2400/482* (2013.01); *A41D 2400/82* (2013.01)

(58) Field of Classification Search

CPC ..... A41D 1/205; A47G 9/10; A47D 5/006

USPC ..... 2/46, 48, 69

See application file for complete search history.

(56) References Cited

U.S. PATENT DOCUMENTS

| | | | | | |
|---|---|---|---|---|---|
| 2,420,344 | A * | 5/1947 | Cook | A47G 9/064 | 2/69 |
| 7,076,816 | B1 * | 7/2006 | Nielsen | A47G 9/062 | 297/188.06 |
| 7,131,156 | B1 * | 11/2006 | Walker-Craft | A47G 9/1045 | 5/655 |
| 7,316,035 | B2 * | 1/2008 | Archambault | A41B 13/00 | 2/46 |
| 8,464,374 | B1 * | 6/2013 | Thayer | A47G 9/08 | 2/69 |
| 2007/0239123 | A1 * | 10/2007 | Pressler | A41B 13/00 | 604/361 |
| 2008/0201815 | A1 * | 8/2008 | Barclay | A41D 1/205 | 2/48 |

* cited by examiner

*Primary Examiner* — Katherine M Moran
(74) *Attorney, Agent, or Firm* — Armstrong Teasdale LLP

(57) ABSTRACT

An infant comfort cloth system includes a substrate having a length between a first edge and a second edge, and a width and configured to be worn over a shoulder of an adult caregiver. The system also includes one or more storage pockets formed adjacent the first edge and a pillow portion spaced away from the second edge a first predetermined distance and spaced away from the one or more storage pockets a second predetermined distance.

17 Claims, 6 Drawing Sheets

BABY SLEEP COMFORT SYSTEM

CROSS REFERENCE TO RELATED APPLICATIONS

This application claims priority to and the benefit of the filing date of U.S. Provisional Application No. 62/199,731 filed on Jul. 31, 2015, which is hereby incorporated by reference in its entirety.

BACKGROUND

This description relates to protective devices for clothing, and, more particularly, to cloths for aiding a baby's comfort for feeding and resting.

Babies respond principally to their current level of comfort. Displays of agitation such as, crying and fussiness are almost always traceable to the baby's low level of comfort at the time of the agitation. Remedying the discomfort usually returns the baby to a peaceful, docile state in a short amount of time. A lack of rest, hunger, messy diaper, and gastrointestinal discomfort, including swallowed air are usually the first and most common sources of discomfort. A caregiver of the baby usually tries a cycle of activities to address these issues, changing the baby's diaper, feeding the baby, burping the baby, and then trying to get the baby to sleep is the usual order of activities. However, as these activities are carried out, other aspects of the baby's comfort may be ignored. For example, babies prefer soft cushioned surfaces to hard surfaces. While holding a baby on the caregiver's shoulder to aid in resting, the body of the caregiver may present pressure points on the baby where the shoulder bones of the caregiver contact the baby. Additionally, the baby may be jostled out of sleep by a caregiver who has to move to reach an inconveniently placed needed accessory.

BRIEF DESCRIPTION

In one embodiment, an infant comfort cloth system includes a substrate having a length between a first edge and a second edge, and a width and configured to be worn over a shoulder of an adult caregiver. The system also includes one or more storage pockets formed adjacent the first edge and a pillow portion spaced away from the second edge a first predetermined distance and spaced away from the one or more storage pockets a second predetermined distance.

In another embodiment, an infant comfort cloth system includes a substrate having a first inner surface and a second outer surface and configured to be worn over a shoulder of an adult caregiver with the first inner surface in contact with the caregiver. The substrate extends between a first edge and a second edge, the first inner surface including a gripping feature. The substrate further includes one or more storage pockets formed on the second outer surface adjacent the first edge and a pillow portion formed on the second outer surface spaced away from the second edge a first predetermined distance and spaced away from the one or more storage pockets a second predetermined distance.

BRIEF DESCRIPTION OF THE DRAWINGS

FIG. 1 is a perspective view of an infant comfort cloth system in accordance with an example embodiment of the present disclosure.

FIG. 2 is another perspective view of the infant comfort cloth system.

FIG. 3 is a perspective view of the pillow portion shown in FIG. 1 and the back portion shown in FIG. 1 in accordance with an example embodiment of the present disclosure.

FIG. 4 is another perspective view of the pillow portion shown in FIG. 1 and the back portion also shown in FIG. 1 in accordance with an example embodiment of the present disclosure.

FIG. 5 is a perspective view of accessory pocket portion illustrating accessories positioned within storage pockets.

FIG. 6 illustrates infant the comfort cloth system shown in FIG. 1 in use with an infant resting on pillow portion and back portion extending over a shoulder of a caregiver.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to aiding the comfort of babies in commercial and residential applications.

Embodiments of a burp cloth system with storage pockets and a removable pillow of the present disclosure provides infants with quickly achieved comfort that helps them fall asleep faster after feedings. The burp cloth system includes a cushioned pillow area at one end, which offers improved resting comfort for a recently fed infant, and storage pockets at the opposite end, which can contain and keep within convenient reach other items for the care and feeding of the infant.

The burp cloth system features a swatch of soft material for use as a burp cloth, a removable pillow on one end of this burp cloth, and one or more storage pockets at the opposite end of the burp clot system. In one embodiment, the burp cloth system can be used as a burp cloth, which is superior to known burp cloths and is more comfortable for infants than are the known burp cloths.

The burp cloth system helps infants obtain better rest than known burp cloths can. Whereas most infants are likely to fall asleep after feedings and subsequent burpings, the burp cloth system addresses an established need in their care. Whereas infants commonly search for comfort immediately after feedings and subsequent burpings in order to achieve desired sleep, the burp cloth system provides that comfort. Infants commonly use many minutes to achieve that comfort after feedings and subsequent burpings, however, the structure and materials of the burp cloth system provide that comfort immediately.

Figure 1:
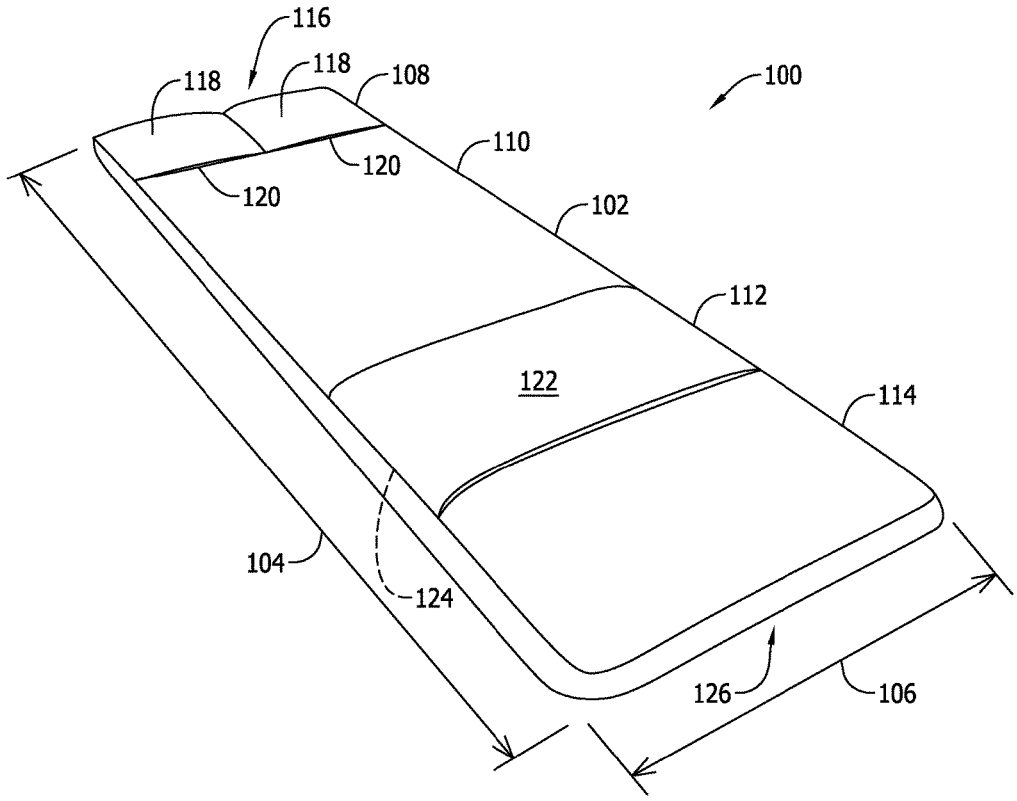
FIGS. 1-6 show example embodiments of the systems described herein.
Figure 2:
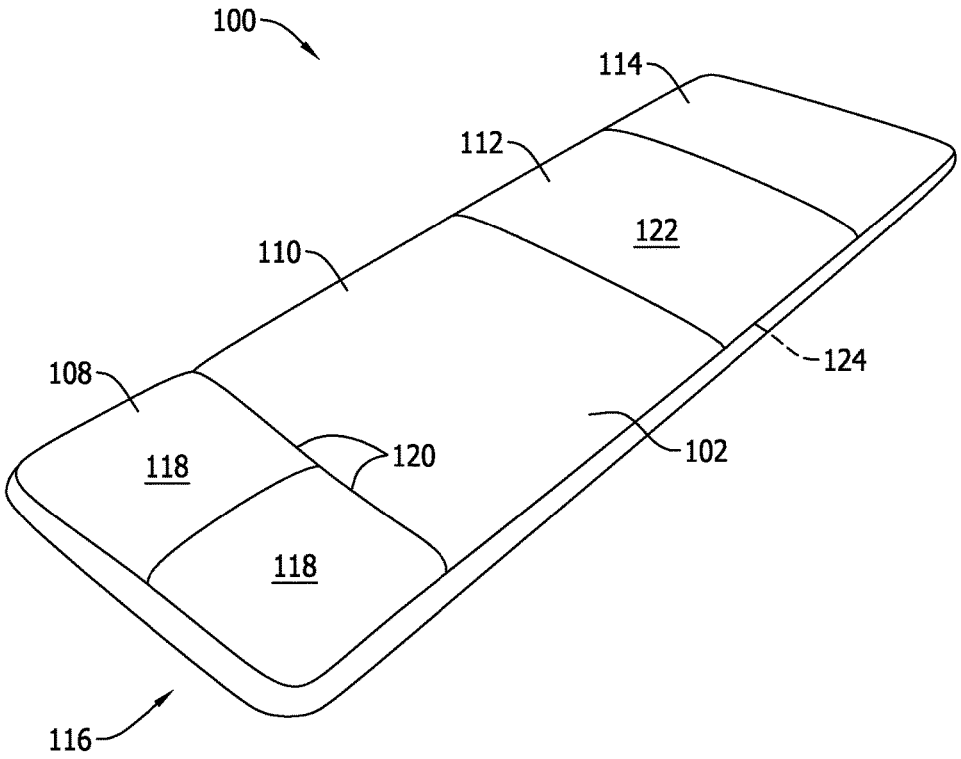

FIG. 1 is a perspective view of an infant comfort cloth system 100 in accordance with an example embodiment of the present disclosure. FIG. 2 is another perspective view of infant comfort cloth system 100. Infant comfort cloth system 100 is configured to be used as a burp cloth for use after feeding a baby, as a changing pad for use in cushioning the baby during diaper changing, and as a mini-blanket. In the example embodiment, infant comfort cloth system 100 includes a fabric substrate 102 having a length 104 and a width 106. In a presently preferred example, and by way of example and not limitation, infant comfort cloth system 100 is made of a plush cotton material that measures approximately twenty-four inches in length by twelve inches in width (24"×12"), and an approximate half-inch (½") folded border is sewn about the perimeter of the structure. Infant comfort cloth system 100 can be made of various materials of adequate durability, including but not limited to cotton, cotton flannel, polyester fabric, terry cloth, and any combination of these and/or other materials. In one embodiment, fabric substrate 102 includes multiple layers of material wherein one or more layers are liquid absorbent and other layers are liquid impermeable. In various embodiments, substrate 102 includes an inner surface, defined to be facing toward the adult caregiver and away from the baby, which includes a gripping surface. The gripping surface may have a relatively rough surface or a relatively sticky or tactified surface, for example, but not limited to, a synthetic rubber-like material and corduroy. The gripping surface tends to hold burp cloth system 100 in position on the caregiver's shoulder while in use.

Infant comfort cloth system 100 includes portions spaced along length 104, namely, an accessory pocket portion 108, a chest portion 110, a pillow portion 112, and a back portion 114.

Accessory pocket portion 108 is formed along a first end 116 of fabric substrate 102. Accessory pocket portion 108 includes one or more storage pockets 118 that are formed of a material affixed to first end 116 having access openings 120 open towards adjacent chest portion 110. As such, storage pockets 118 may be formed of a material different than fabric substrate 102 or may be formed of a portion of fabric substrate 102 that is folded back on itself with seams fastened to fabric substrate 102. Storage pockets 118 may also include closures including elasticized hems, a flap, a snap, a button, a zipper, and a hook-and-loop material to protectively retain the contents of storage pockets 118. Accordingly, infant comfort cloth system 100 allows quick and easy access to the baby-care products held within storage pockets 118. Accessory pocket portion 108 may host other needed items within storage pockets 118, such as, but not limited to cleaning cloths, medications, pacifiers and other baby-care products. Storage pockets 118 may also include a shape that is complementary to an object of intended storage. For example, storage pockets 118 may be shaped to accommodate an outline of a baby bottle or travel pack of baby wipes.

In one embodiment, accessory pocket portion 108 includes two storage pockets. In various other embodiments, accessory pocket portion 108 includes more than two storage pockets.

Chest portion 110 extends away from accessory pocket portion 108 to an area of a user's chest when used as a burp cloth. Pillow portion 112 extends away from chest portion 110 and is formed with a front sidewall 122 and a back sidewall 124 configured to receive a resting pillow or cushion (not shown in FIGS. 1 and 2) within a space between front sidewall 122 and back sidewall 124 in the position on which infants rest their heads after feedings and subsequent burpings. Pillow portion 112 is configured to rest on a shoulder of the user and to extend to cover a front side and a back side of the user's shoulder area. Infant comfort cloth system 100 provides a comfortable resting surface upon which the infant can rest his or her head. A thickness of the pillow is sufficient to reduce a hardness and sharpness of the bony structure of the user's shoulder and helps infants find comfort faster in comparison to using standard burping cloths. The pillow of infant comfort cloth system 100 is removable, allowing the entire infant comfort cloth system 100 to be conveniently machine-washed. Back portion 114 extends from pillow portion 112 and forms a second end 126 of infant comfort cloth system 100.

Figure 3:
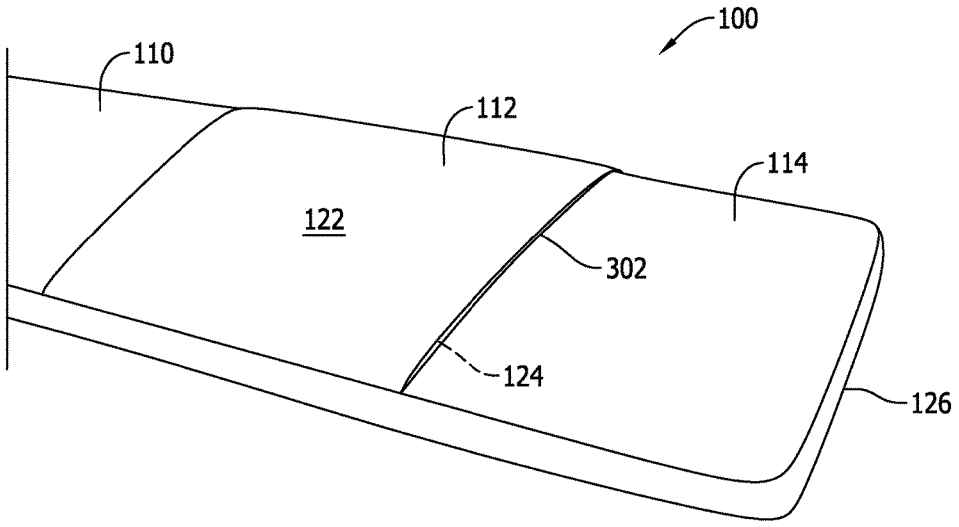
Figure 4:
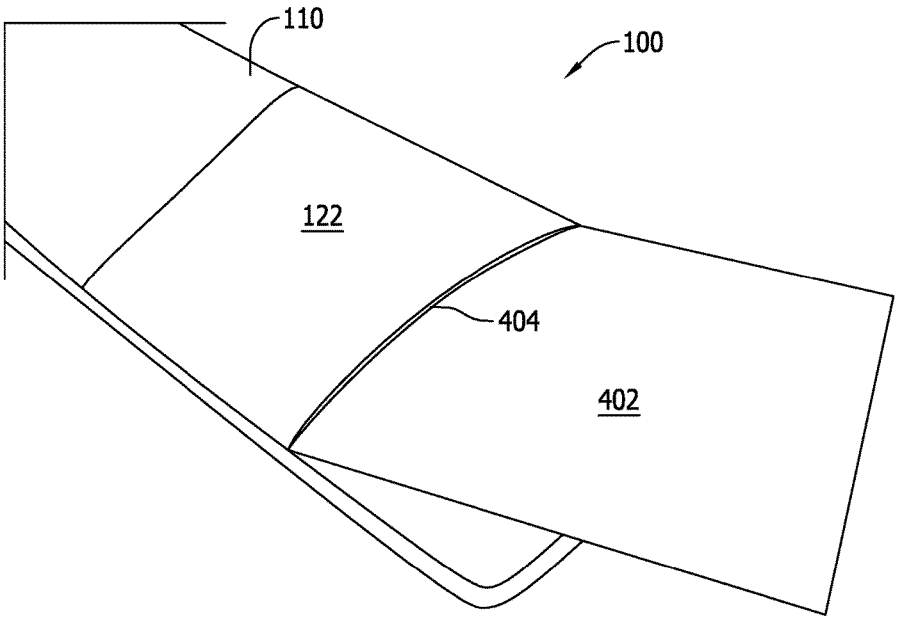

FIGS. 3 and 4 are perspective view of pillow portion 112, and a back portion 114 in accordance with an example embodiment of the present disclosure. The opening is present in at least one of the front sidewall and the back sidewall to provide access to the space. In the example embodiment, pillow portion 112 includes an opening 302 for access to a pillow 402 positioned in space 404 between front sidewall 122 and back sidewall 124. In various embodiments, pillow 402 is formed of various materials, such as but not limited to polyester foam, latex rubber, and feathers/down. In various other embodiments pillow 402 is formed in variations that include scented material, such as but not limited to lavender and menthol for comfort and/or medicinal purposes, such as but not limited to sinus decongestion. Opening 302 is positioned approximately four inches (4") from second end 126 for access to space 404, which measures approximately eight inches in length by eleven inches in width (8"×11"). Pillow 402, measuring approximately eight inches in length by eleven inches in width by three-quarters of an inch in depth (8"×11"×¾") is inserted within space 404. Pillow 402 is formed of polyester foam and is encased within a cotton fabric.

Figure 5:
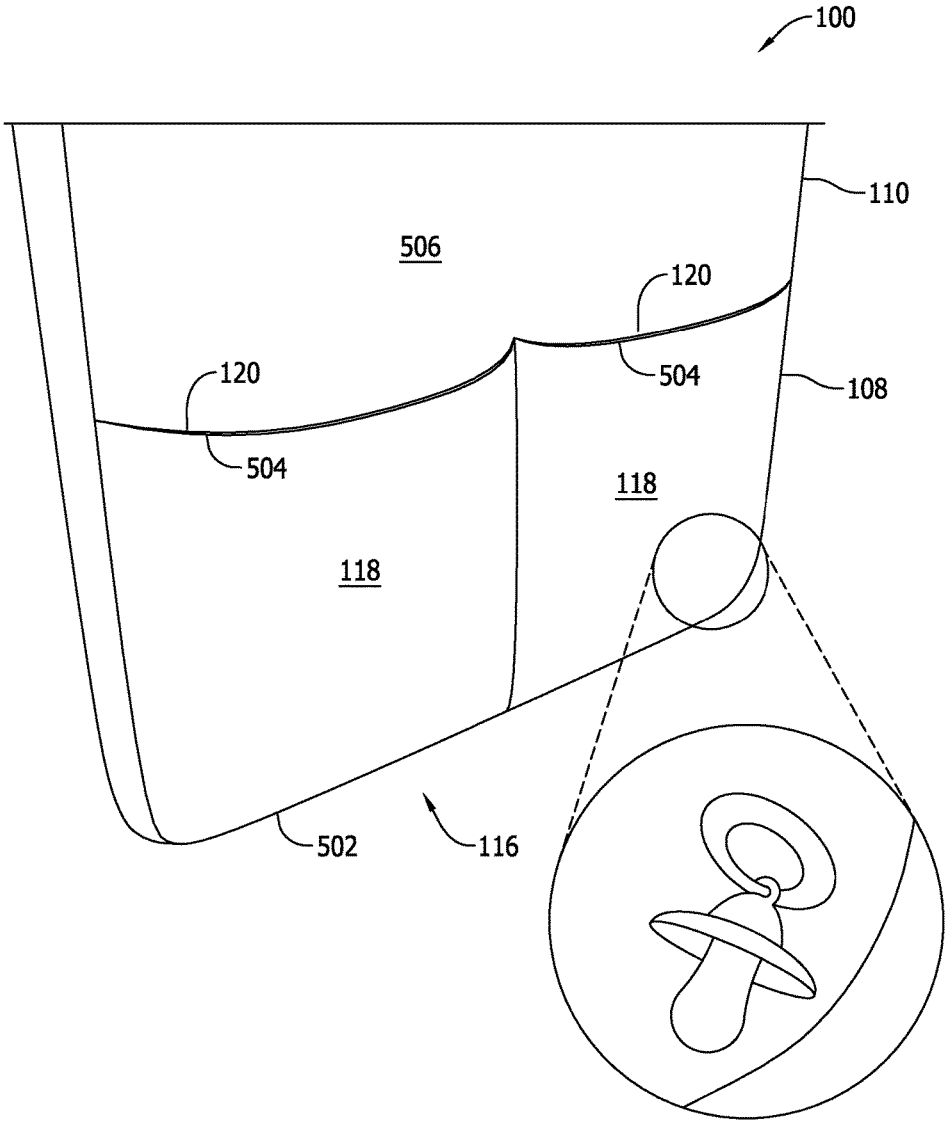

FIG. 5 is a perspective view of accessory pocket portion 108 illustrating accessories such as, a container of cleaning wipes 502 and a pacifier 504 positioned within storage pockets 118, which each measure four inches in length by six inches in width (4"×6"), and are positioned parallel to each other directly above a bottom hem 502. Storage pockets 118 each feature an elasticized hem 504 at their upper borders 506. Accessory pocket portion 108 permits baby-care products to be administered quickly and easily and eliminates the need for a parent or caregiver to move to obtain baby-care products. By eliminating the need for a parent or caregiver to move to obtain those baby-care products, infant comfort cloth system 100 eliminates any discomfort and interruption upon the infant who the parent or caregiver holds. Eliminating the discomfort and interruption caused by motion required for a caregiver to receive needed items, infant comfort cloth system 100 ensures that infants are not awoken or disturbed from comforting rest, which further helps infants maintain sleep for longer uninterrupted periods.

Figure 6:
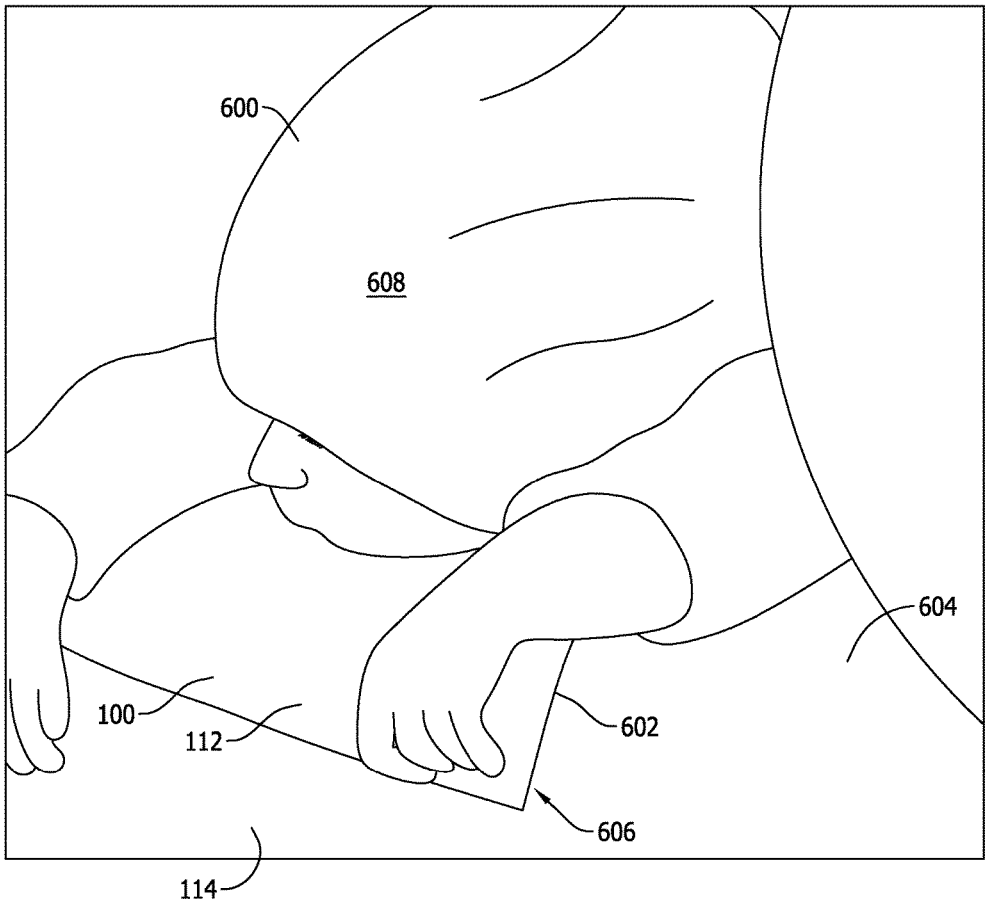

FIG. 6 illustrates infant comfort cloth system 100 in use with an infant 600 resting on pillow portion 112 and back portion 114 extending over a shoulder 602 of a caregiver 604. An adult caregiver 604 of infant comfort cloth system 100 may place it in position so pillow 402 is resting upon a top point of his or her shoulder 602, allowing the remaining four inches (4") in length of back portion 114 to drape over shoulder 602 and rest upon the caregiver's back 606. Caregiver 604 may then hold infant 600 in a burping or resting position, so that a head 608 of infant 600 rests upon pillow portion 112. As infant 600 receives pillow 402 and the comfort it provides, he or she can then take a needed nap. Should caregiver 604 need any other items for the care of infant 600, such as a cloth or pacifier, he or she can obtain such items, as well as other objects, from storage pockets 118 formed in the lower section of infant comfort cloth system 100 in accordance with the present disclosure.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

While the disclosure has been described in terms of various specific embodiments, it will be recognized that the disclosure can be practiced with modification within the spirit and scope of the claims.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An infant comfort cloth system comprising:

a multi-layer substrate having a length between a first edge and an opposing second edge, and a width and configured to be worn over a shoulder of an adult caregiver;

one or more storage pockets formed adjacent the first edge; and a pillow portion extending the entire width and spaced away from the second edge a first predetermined distance and spaced away from said one or more storage pockets a second predetermined distance, said pillow portion comprising:

a space between a front sidewall and an opposing back sidewall;

an opening in at least one of said front sidewall and said back sidewall to provide access to said space; and a pillow positioned in said space and accessible through said opening.

2. The system of claim 1, wherein said one or more storage pockets comprise a closure device configured to retain items within said one or more storage pockets.

3. The system of claim 1, wherein said one or more storage pockets comprise a shape complementary to at least one of a cleaning cloth, a medication container, a pacifier, a baby bottle, and a travel pack of baby wipes.

4. The system of claim 1, wherein said substrate is formed of one or more layers of a liquid impermeable material.

5. The system of claim 1, wherein said one or more storage pockets are formed of a portion of said substrate folded over itself.

6. The system of claim 1, wherein said one or more storage pockets are formed of a separate material coupled to said substrate.

7. The system of claim 1, wherein said substrate includes in order from said first edge an accessory pocket portion including the one or more storage pockets, a chest portion, pillow portion, and a back portion.

8. The system of claim 1, wherein said substrate comprises an inner surface comprising a gripping surface.

9. The system of claim 8, wherein said gripping surface comprises a rough surface capable of holding the infant comfort cloth system in position against a surface while in use.

10. The system of claim 8, wherein said gripping surface comprises a corduroy material.

11. An infant comfort cloth system comprising:

a substrate having a first inner surface and a second outer surface and configured to be worn over a shoulder of an adult caregiver with the first inner surface in contact with the caregiver, said substrate extending between a first edge and a second opposing edge and having a width, said first inner surface comprising a gripping feature;

one or more storage pockets formed on said second outer surface adjacent the first edge; and a pillow portion comprising a pocket comprising a space between a front sidewall and an opposing back sidewall and configured to receive a removable pillow through an opening in at least one of said front sidewall and said back sidewall and extending the entire width of the substrate and spaced away from the second edge a first predetermined distance and spaced away from said one or more storage pockets a second predetermined distance.

12. The system of claim 11, wherein said one or more storage pockets comprise a closure device configured to retain items within said one or more storage pockets.

13. The system of claim 11, wherein said one or more storage pockets comprise a shape complementary to at least one of a cleaning cloth, a medication container, a pacifier, a baby bottle, and a travel pack of baby wipes.

14. The system of claim 11, wherein said substrate is formed of one or more layers of a fabric material.

15. The system of claim 11, wherein said substrate is formed of one or more layers of a liquid impermeable material.

16. The system of claim 11, wherein said gripping feature comprises a rough surface capable of holding the infant comfort cloth system in position against a surface while in use.

17. The system of claim 11, wherein said gripping feature comprises a corduroy material.

* * * * *